US009579880B2

(12) United States Patent
Kusaka

(10) Patent No.: US 9,579,880 B2
(45) Date of Patent: Feb. 28, 2017

(54) SCREEN PRINTING APPARATUS AND COMBINATION PRINTING PRESS INCLUDING THE SCREEN PRINTING APPARATUS

(71) Applicant: KOMORI CORPORATION, Tokyo (JP)

(72) Inventor: Akehiro Kusaka, Tsukuba (JP)

(73) Assignee: Komori Corporation, Tokyo (JP)

( * ) Notice: Subject to any disclaimer, the term of this patent is extended or adjusted under 35 U.S.C. 154(b) by 0 days.

(21) Appl. No.: 13/969,062

(22) Filed: Aug. 16, 2013

(65) Prior Publication Data

US 2014/0047991 A1 Feb. 20, 2014

(30) Foreign Application Priority Data

Aug. 17, 2012 (JP) ..... 2012-180752
Sep. 21, 2012 (JP) ..... 2012-207752

(51) Int. Cl.

| | |
|---|---|
| ***B41F 15/44*** | (2006.01) |
| ***B41F 31/22*** | (2006.01) |
| ***B41F 11/02*** | (2006.01) |
| ***B41F 15/08*** | (2006.01) |
| ***B41F 15/42*** | (2006.01) |

(52) U.S. Cl.

CPC ..... *B41F 15/44* (2013.01); *B41F 11/02* (2013.01); *B41F 15/0809* (2013.01); *B41F 15/42* (2013.01); *B41F 31/22* (2013.01)

(58) Field of Classification Search

CPC ..... B41F 15/42; B41F 15/44; B41F 15/0809; B41L 13/04; B41L 13/06; B41L 13/18

USPC ..... 101/120, 116, 119

See application file for complete search history.

(56) References Cited

U.S. PATENT DOCUMENTS

| | | | | |
|---|---|---|---|---|
| 4,103,615 | A * | 8/1978 | Cruz et al. | 101/120 |
| 5,375,516 | A * | 12/1994 | Hasegawa | 101/116 |
| 6,546,866 | B1 * | 4/2003 | Adachi et al. | 101/366 |
| 6,655,270 | B2 * | 12/2003 | Schaede | 101/116 |

(Continued)

FOREIGN PATENT DOCUMENTS

| | | |
|---|---|---|
| EP | 0711663 A1 | 5/1996 |
| EP | 1 820 646 A2 | 8/2007 |

(Continued)

OTHER PUBLICATIONS

Extended European Search report dated Jan. 2, 2014 for corresponding Application No. EP 13 18 0472.

Communication Pursuant to Rule 114(2) EPC dated Oct. 13, 2014.

*Primary Examiner* — Leslie J Evanisko

(74) *Attorney, Agent, or Firm* — Birch, Stewart, Kolasch & Birch, LLP

(57) ABSTRACT

In a screen printing apparatus including: an impression cylinder that receives a sheet from a transfer cylinder located upstream in the sheet transport direction through a sheet gripping device and transports the sheet held in the sheet gripping device; and a rotary screen cylinder that is in contact with the impression cylinder and performs screen printing for the sheet held by the impression cylinder, the transfer cylinder is located above the impression cylinder, and the rotary screen cylinder is located to the side of the impression cylinder so that ink, varnish, or the like accumulates in a squeegee portion including a squeegee shaft, a squeegee, and the like in the rotary screen cylinder.

6 Claims, 9 Drawing Sheets

(56) References Cited

U.S. PATENT DOCUMENTS

| | | | | |
|---|---|---|---|---|
| 6,681,690 | B2 * | 1/2004 | Schaede | 101/120 |
| 6,901,861 | B2 * | 6/2005 | Adachi et al. | 101/483 |
| 2003/0010230 | A1 | 1/2003 | Schaede | |
| 2003/0015106 | A1 | 1/2003 | Schaede | |
| 2005/0199146 | A1 | 9/2005 | Kusaka | |
| 2007/0119316 | A1 | 5/2007 | Sugiyama | |
| 2007/0289463 | A1 | 12/2007 | Kusaka | |
| 2011/0192298 | A1 * | 8/2011 | Ishiwata et al. | 101/167 |
| 2013/0312625 | A1 | 11/2013 | Kamoda | |

FOREIGN PATENT DOCUMENTS

| | | | |
|---|---|---|---|
| EP | 2 189 286 | A2 | 5/2010 |
| JP | 53-70182 | A | 6/1978 |
| JP | 53-119391 | A | 10/1978 |
| JP | 8-276564 | A | 10/1996 |
| JP | 2000-108304 | A | 4/2000 |
| JP | 2000-351197 | A | 12/2000 |
| JP | 2003-520708 | A | 7/2003 |
| JP | 2003-520709 | A | 7/2003 |
| JP | 2004-9365 | A | 1/2004 |
| JP | 2004-34641 | A | 2/2004 |
| JP | 2005-254640 | A | 9/2005 |
| JP | 2006-321157 | A | 11/2006 |
| JP | 2007-331223 | A | 12/2007 |
| JP | 2009-18564 | A | 1/2009 |
| JP | 2011-161707 | A | 8/2011 |
| JP | 2012-139995 | A | 7/2012 |
| WO | WO 01/54905 | A1 | 8/2001 |
| WO | WO 01/54906 | A1 | 8/2001 |
| WO | WO 01/54907 | A1 | 8/2001 |
| WO | WO 01/54908 | A1 | 8/2001 |

* cited by examiner

SCREEN PRINTING APPARATUS AND COMBINATION PRINTING PRESS INCLUDING THE SCREEN PRINTING APPARATUS

TECHNICAL FIELD

The present invention relates to a screen printing apparatus performing screen printing for a sheet and a combination printing press including the screen printing apparatus.

BACKGROUND ART

One of conventional printing apparatuses for performing screen printing is disclosed in Patent Literature 1, for example.

According to Patent Literature 1, first, in the screen printing apparatus provided in combination with an offset printing apparatus, the rotary screen cylinder is located above an impression cylinder that holds and transports a sheet to be subjected to screen printing.

Next, the screen printing apparatus includes a rotary screen cylinder, a pair of eccentric bearings, driving means, and a controller. The rotary screen cylinder includes a cylindrical screen plate that is supported between a pair of holders with flanges interposed therebetween. The eccentric bearings support the pair of respective holders of the rotary screen cylinder such that the holders can rotate. The driving means includes a pair of motors and moves the pair of holders along a cylinder shaft direction through the pair of eccentric bearings. The controller drives and controls the driving means so that the pair of holders move close to or apart from each other along the cylinder shaft direction to support and release the screen printing plate. Moreover, the controller drives and controls the driving means so that the pair of holders synchronously move in the same direction along the cylinder shaft direction by the same amount to move the screen printing plate in the cylinder shaft direction.

CITATION LIST

Patent Literature

{Patent Literature 1} Japanese Patent Application Publication No. 2006-321157

SUMMARY OF INVENTION

Technical Problem

By the way, in the printing apparatus disclosed in Patent Literature 1, the rotary screen cylinder is located above the impression cylinder, and the pair of holders always applies tension force to the screen plate of the rotary screen cylinder in the cylinder shaft direction.

Accordingly, when the rotary screen cylinder is broken because of deterioration due to aging, interferences by others, and the like, ink, varnish, or the like accumulated within the rotary screen cylinder could leak to the outside and drop on the peripheral units, such as the impression cylinder, thus causing great damage.

Accordingly, an object of the present invention is to provide a screen printing apparatus which is capable of minimizing damage by screen printing liquid in the event of breakage of the rotary screen cylinder without impairing the function of supplying the screen printing liquid in the process of printing and provide a combination printing press including the screen printing apparatus.

Solution to Problem

A screen printing apparatus according to the present invention to achieve the aforementioned object provides a screen printing apparatus, including: an impression cylinder including a sheet holding device for holding a sheet and being configured to receive the sheet from an upstream sheet transport device through the sheet holding device and transport the sheet; and a rotary screen cylinder being in contact with the impression cylinder and configured to perform screen printing for the sheet held on the impression cylinder, in which the upstream sheet transport device is located above the impression cylinder, and the rotary screen cylinder is located to the side of the impression cylinder so that screen printing liquid accumulates in a squeegee portion of the rotary screen cylinder.

Moreover, in the screen printing apparatus, an installation angle θ of a squeegee of the squeegee portion is set at not less than 0 degrees with respect to a horizontal plane in a lateral direction of the squeegee.

Furthermore, the screen printing apparatus further includes: the squeegee abutting on an inner circumferential surface of a cylindrical screen plate that is attached to the rotary screen cylinder and includes a plurality of holes, the squeegee being configured to push out liquid supplied to the inner circumferential surface of the screen plate through the holes onto a surface of the sheet held on the impression cylinder; a tank configured to reserve the liquid; a liquid supply device configured to supply the liquid reserved in the tank onto the squeegee; and a liquid recovery device configured to return the liquid flowing out of the squeegee to the tank, in which the squeegee is inclined with respect to the horizontal plane in the longitudinal direction of the squeegee so that one end of the squeegee in the longitudinal direction is located higher than the other end thereof, and the liquid supply device supplies the liquid to the one end of the squeegee while the liquid recovery device recovers the liquid from the other end of the squeegee.

Still furthermore, the screen printing apparatus further includes a squeegee angle adjustment device configured to adjust an angle of inclination of the squeegee with respect to the horizontal plane in the longitudinal direction of the squeegee.

A combination printing press according to the present invention to achieve the aforementioned object provides a combination printing press, including: the above-described screen printing apparatus; a convertible portion; and an intaglio printing apparatus.

Moreover, the combination printing press further includes an offset printing apparatus.

Advantageous Effects of Invention

With the screen printing apparatus according to the present invention, the rotary screen cylinder is located to the side of the impression cylinder without impairing the function of supplying screen printing liquid to the sheet in the process of printing. It is therefore possible to minimize the damage on the peripheral members including the impression cylinder by screen printing liquid that accumulates in the cylinder and scatters to the outside in the event of breakage of the rotary screen cylinder by deterioration of the screen plate due to aging, thus increasing the reliability of the screen printing apparatus.

With the combination apparatus according to the present invention, it is possible to perform various types of printing in one pass, including intaglio printing and offset printing, thus increasing the versatility of the printing press as well as the reliability of the screen printing apparatus.

DESCRIPTION OF EMBODIMENTS

Hereinafter, a description is given of a screen printing apparatus according to the present invention and a combination printing press including the screen printing apparatus in detail based on an embodiment using the drawings.

EXAMPLES

Figure 1:
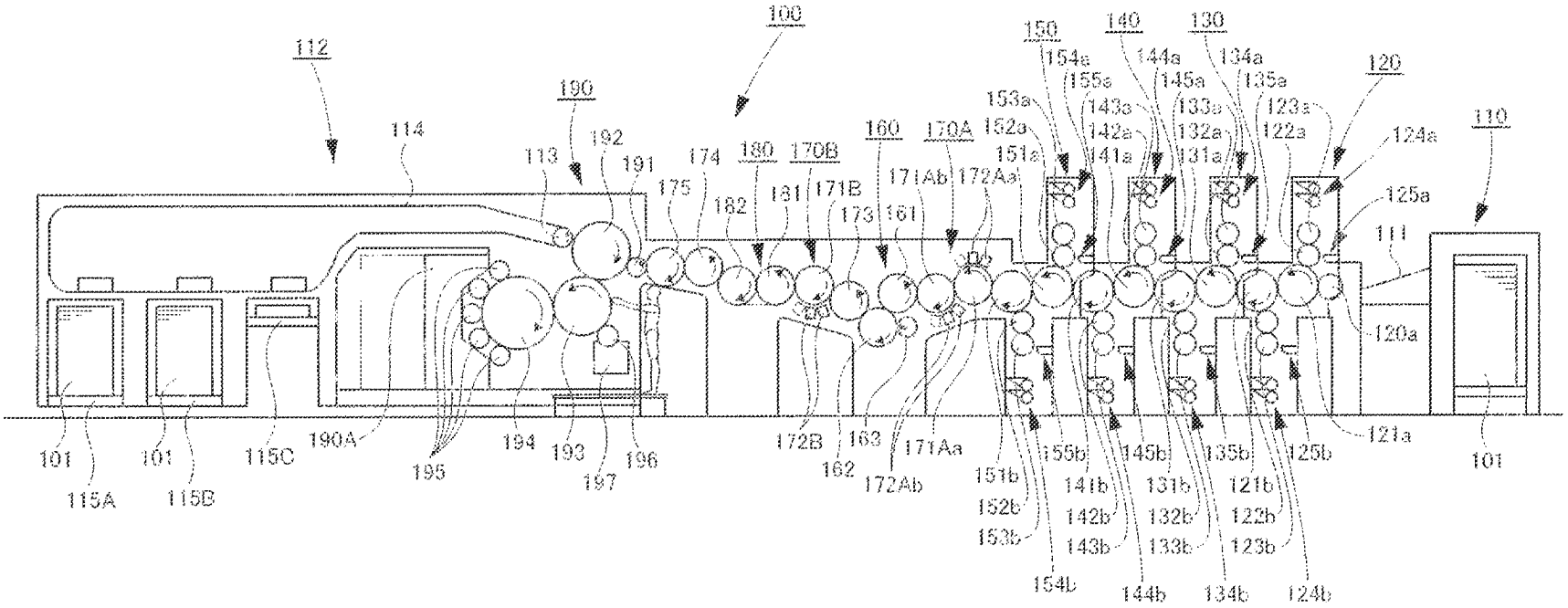
FIG. 1 is a schematic configuration side view of a combination printing press illustrating an embodiment of the present invention.
Figure 2:
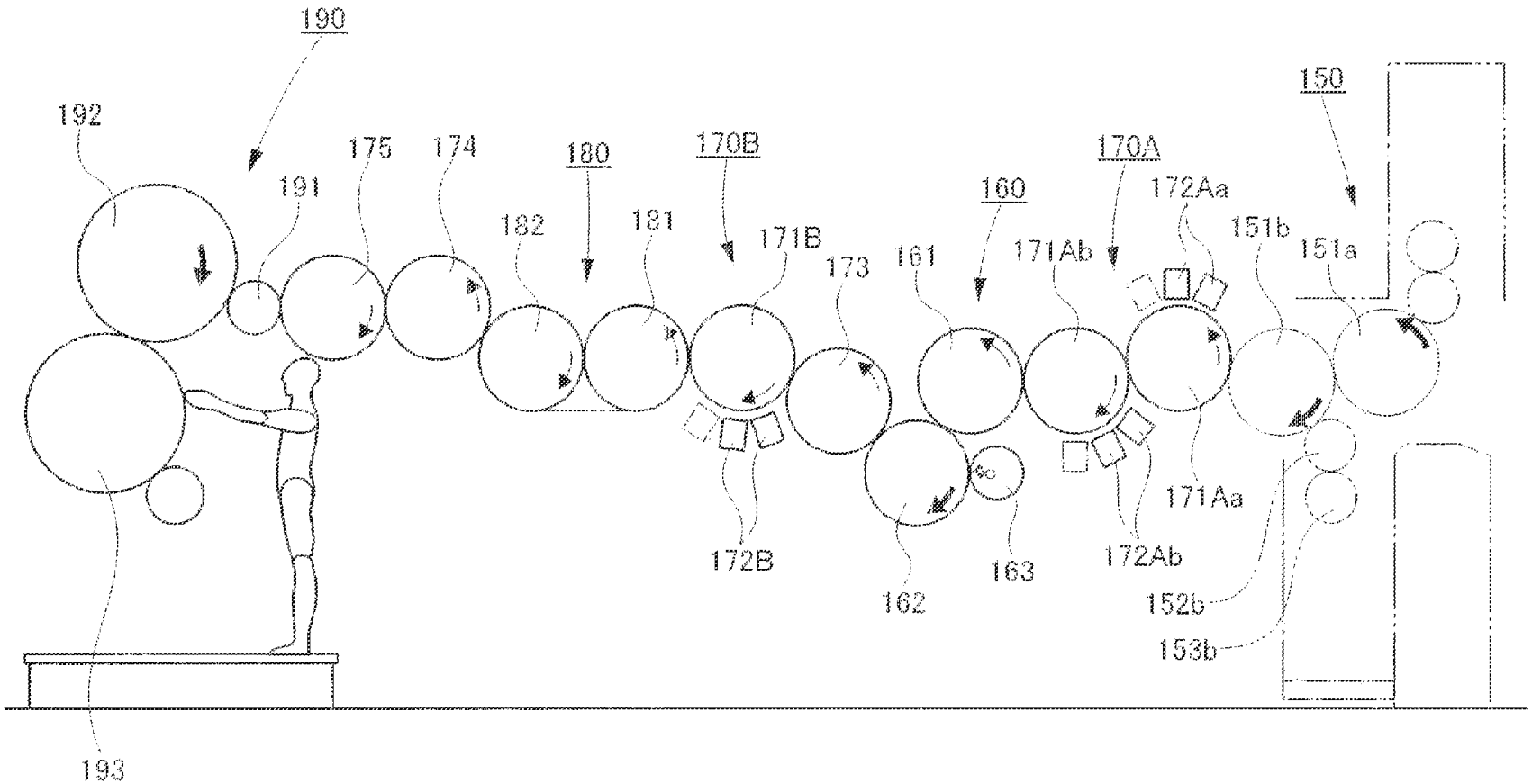
FIG. 2 is an enlarged side view of a screen printing apparatus and a convertible unit of the embodiment of the present invention.
Figure 3:
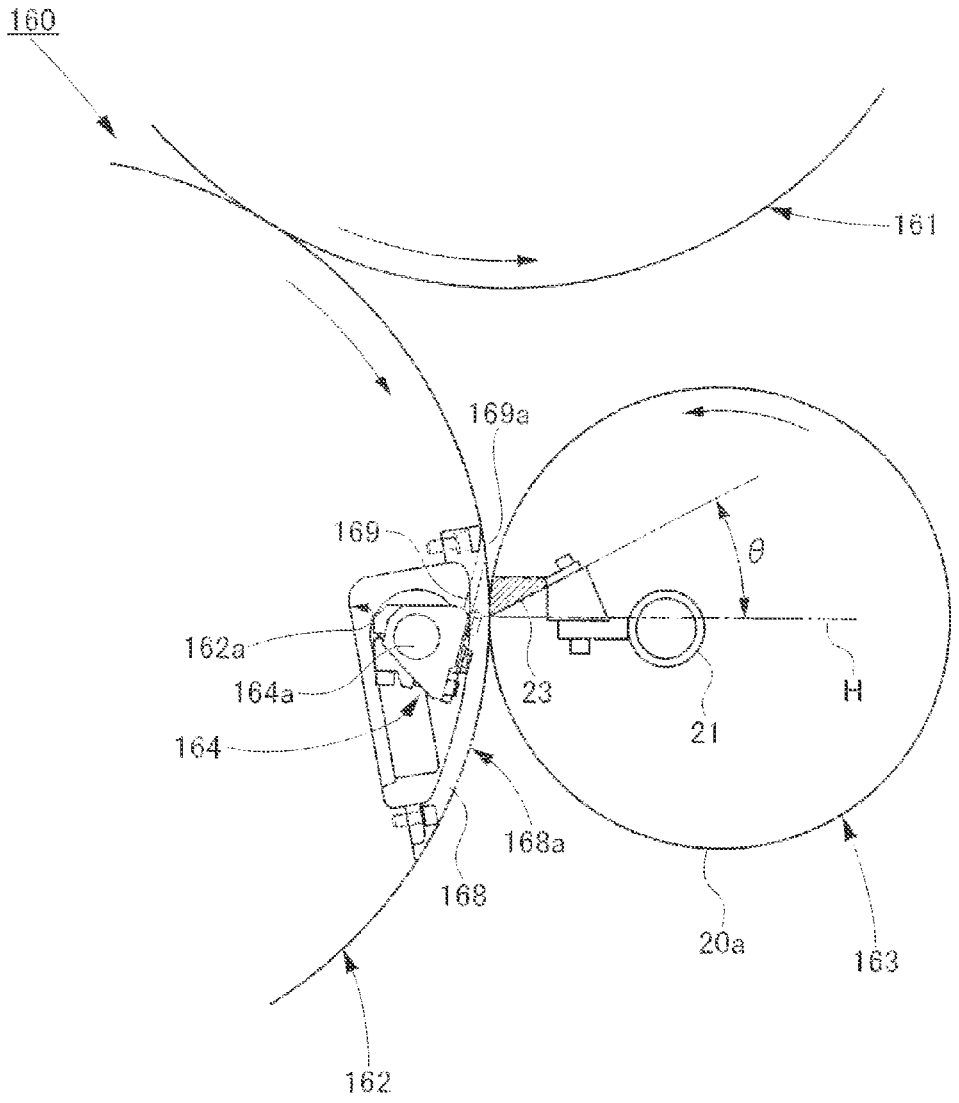
FIG. 3 is a structure explanatory view of a rotary screen cylinder and an impression cylinder of the embodiment of the present invention.
Figure 4:
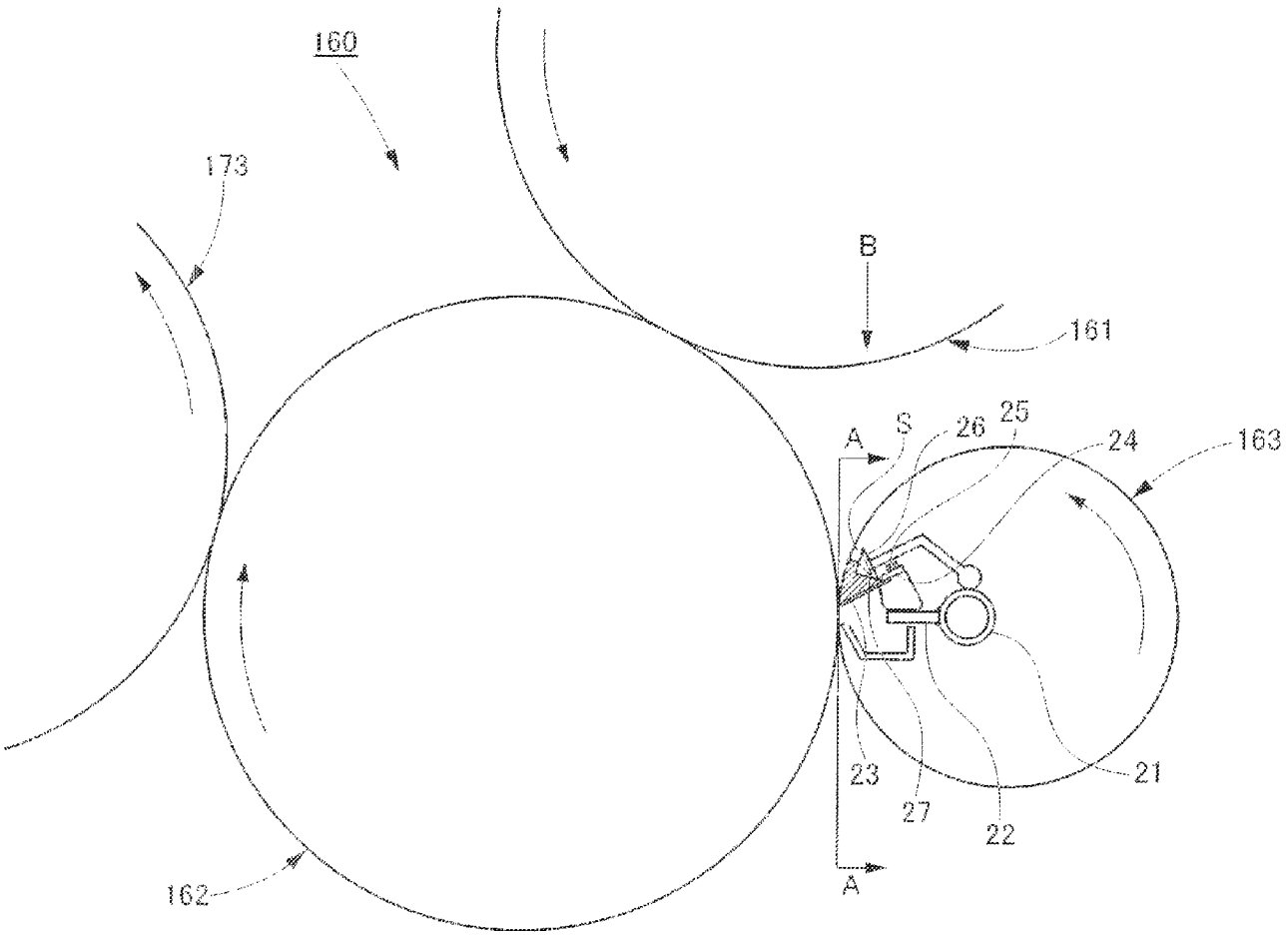
FIG. 4 is a schematic configuration side view of the screen printing apparatus illustrating the embodiment of the present invention.
Figure 5:
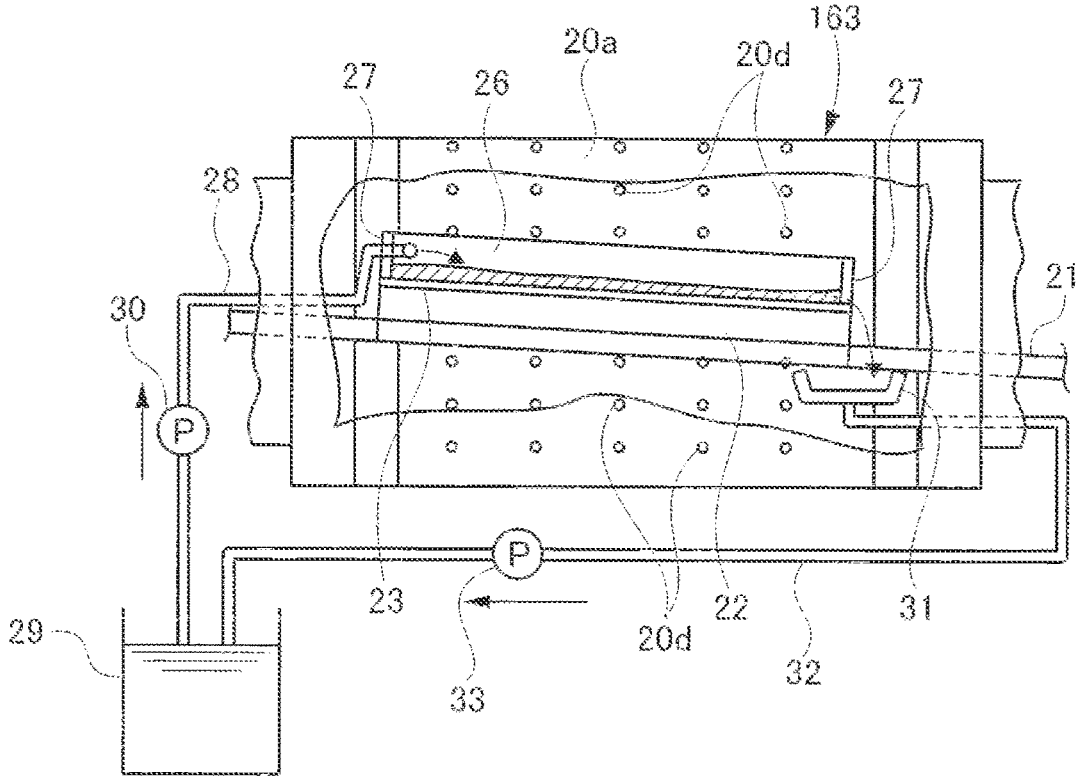
FIG. 5 is a view taken along a line A-A in a direction of arrows A of FIG. 4, illustrating a circulation path of ink.
Figure 6:
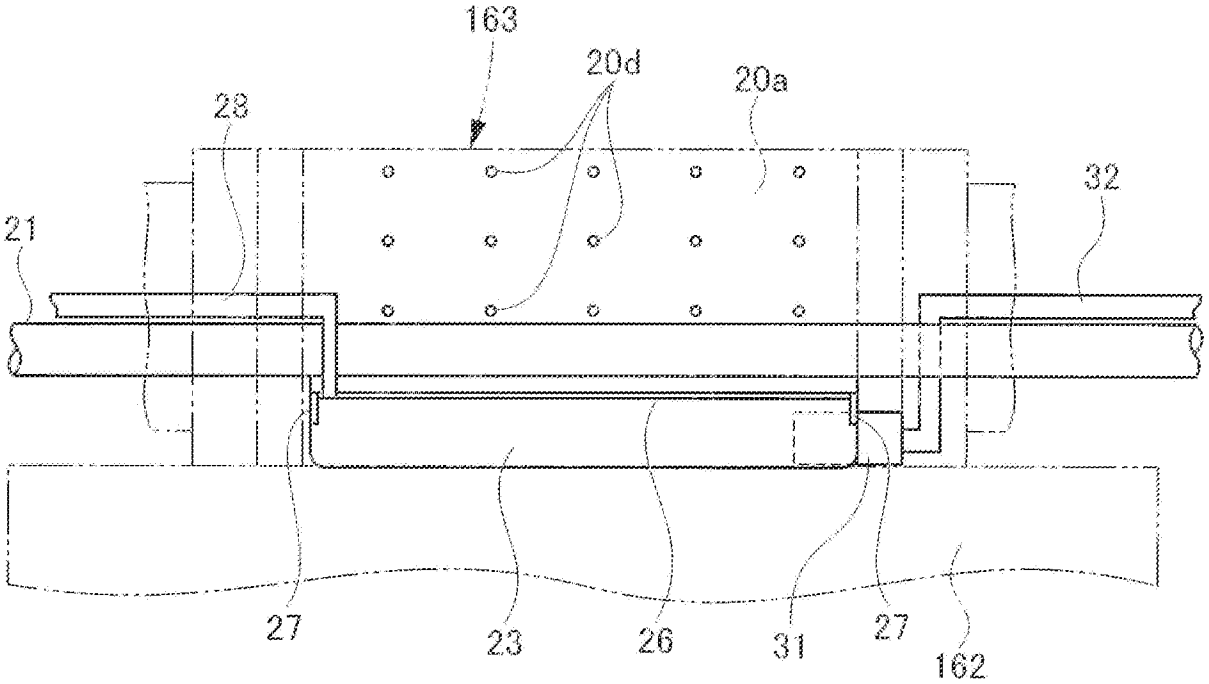
FIG. 6 is a view taken in a direction of an arrow B of FIG. 4.
Figure 7:
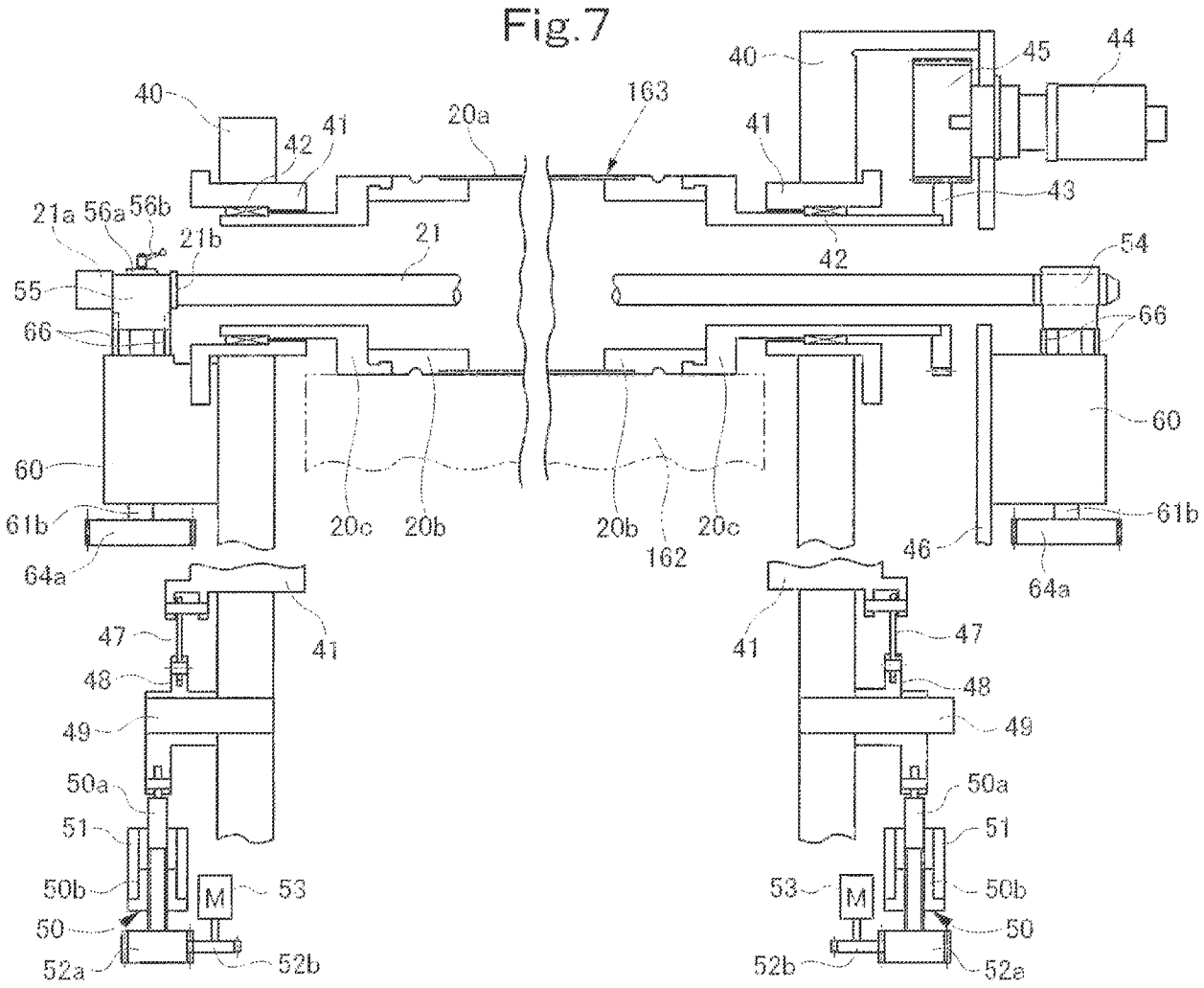
FIG. 7 is an explanatory view illustrating a support structure of the rotary screen cylinder.
Figure 8:
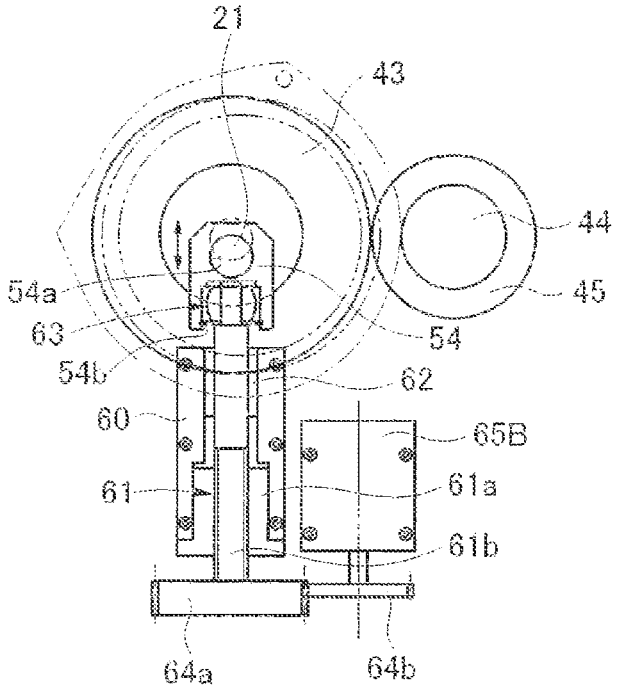
FIG. 8 is a right side view of FIG. 7.
Figure 9:
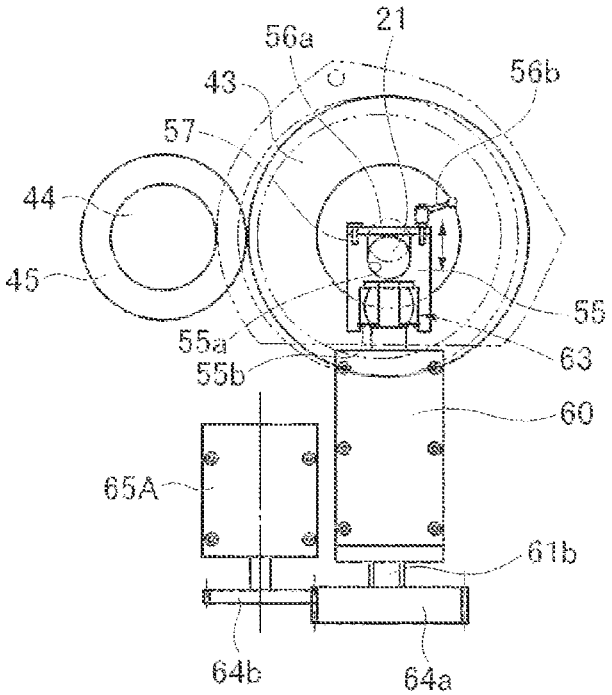
FIG. 9 is a left side view of FIG. 7.
Figure 10:
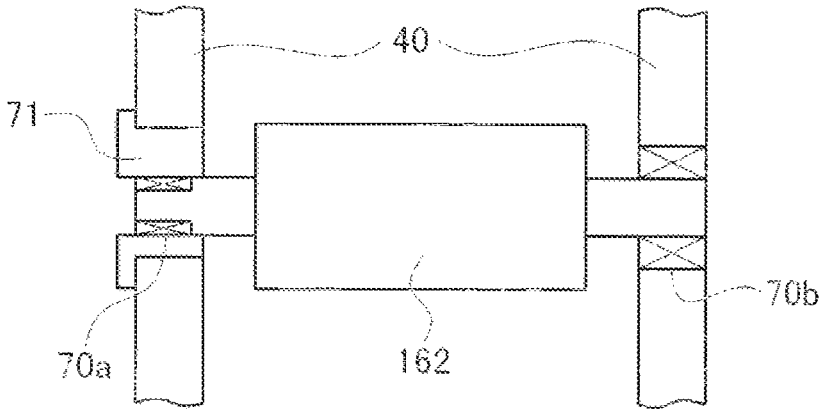
FIG. 10 is a view illustrating a structure to support the impression cylinder.

FIG. 1 is a schematic configuration side view of a combination printing press illustrating an embodiment of the present invention. FIG. 2 is an enlarged side view of a screen printing apparatus and a convertible unit of the embodiment of the present invention. FIG. 3 is a structure explanatory view of a rotary screen cylinder and an impression cylinder of the embodiment of the present invention. FIG. 4 is a schematic configuration side view of the screen printing apparatus illustrating the embodiment of the present invention. FIG. 5 is a view taken along a line A-A in a direction of arrows A of FIG. 4, illustrating a circulation path of ink. FIG. 6 is a view taken in a direction of an arrow B of FIG. 4. FIG. 7 is an explanatory view illustrating a support structure of the rotary screen cylinder. FIG. 8 is a right side view of FIG. 7. FIG. 9 is a left side view of FIG. 7. FIG. 10 is a view illustrating a support structure of the impression cylinder.

First, a description is given of the configuration of the combination printing press according to the embodiment with reference to FIGS. 1 to 3.

As illustrated in FIG. 1, in a combination printing press 100, a transfer cylinder 120*a* of a first offset printing unit (offset printing apparatus) 120 is provided at the front end of a feeder board 111 of a sheet feeder 110 that feeds sheets 101 one by one. The transfer cylinder 120*a* is configured to receive the sheets 101 one by one from the feeder board 111 through a not-shown swing arm shaft pregripper.

The transfer cylinder 120*a* of the first offset printing unit 120 is in contact with an impression cylinder 121*a* for one side of the first offset printing unit 120. The impression cylinder 121*a* is in contact with a blanket cylinder 122*a* for one side. The blanket cylinder 122*a* is in contact with a plate cylinder 123*a* for one side. The plate cylinder 123*a* is provided with an inking device 124*a* for one side as ink supply means for one side and a dampening device 125*a* as dampening means for one side. These impression cylinder 121*a*, blanket cylinder 122*a*, plate cylinder 123*a*, inking device 124*a*, dampening device 125*a*, and the like constitute an offset printing portion for one side of the first offset printing unit 120.

The impression cylinder 121*a* is in contact with an impression cylinder 121*b* for the other side of the first offset printing unit 120 downstream in the direction of rotation of the position of contact between the impression cylinder 121*a* and the blanket cylinder 122*a*. The impression cylinder 121*b* is in contact with a blanket cylinder 122*b* for the other side. The blanket cylinder 122*b* is in contact with a plate cylinder 123*b* for the other side. The plate cylinder 123*b* is provided with an inking device 124*b* for the other side as ink supply means for the other side and a dampening device 125*b* for the other side as dampening means for the other side. These impression cylinder 121*b*, blanket cylinder 122*b*, plate cylinder 123*b*, inking device 124*b*, dampening device 125*b*, and the like constitute an offset printing portion for the other side of the first offset printing unit 120.

The impression cylinder 121*b* for the other side of the first offset printing unit 120 is in contact with an impression cylinder 131*a* for one side of a second offset printing unit (offset printing apparatus) 130 downstream in the direction of rotation of the position of contact between the impression cylinder 121*b* and blanket cylinder 122*b*. In a similar manner to the aforementioned first offset printing unit 120, the second offset printing unit 130 includes the impression cylinder 131*a*, a blanket cylinder 132*a*, a plate cylinder 133*a*, an inking device 134*a*, and a dampening device 135*a* for one side to constitute an offset printing portion for one side. Moreover, the second offset printing unit 130 includes an impression cylinder 131*b*, a blanket cylinder 132*b*, a plate cylinder 133*b*, an inking device 134*b*, and a dampening device 135*b* for the other side to constitute an offset printing portion for the other side.

The impression cylinder 131*b* for the other side of the second offset printing unit 130 is in contact with an impression cylinder 141*a* for one side of a third offset printing unit (offset printing apparatus) 140 downstream in the direction of rotation of the position of contact between the printing impression cylinder 131*b* and the blanket cylinder 132*b*. In a similar manner to the aforementioned first and second offset printing units 120 and 130, the third offset printing unit 140 includes the impression cylinder 141*a*, a blanket cylinder 142*a*, a plate cylinder 143*a*, an inking device 144*a*, and a dampening device 145*a* for one side to constitute an offset printing portion for one side. Moreover, the third offset printing unit 140 includes an impression cylinder 141*b*, a blanket cylinder 142*b*, a plate cylinder 143*b*, an inking device 144*b*, and a dampening device 145*b* for the other side to constitute an offset printing portion for the other side.

The impression cylinder 141*b* for the other side of the third offset printing unit 140 is in contact with an impression cylinder 151*a* for one side of a fourth offset printing unit (offset printing apparatus) 150 downstream in the direction of rotation of the position of contact between the impression cylinder 141*b* and blanket cylinder 142*b*. In a similar manner to the aforementioned first to third offset printing units 120, 130, and 140, the fourth offset printing unit 150 includes the impression cylinder 151*a*, a blanket cylinder 152*a*, a plate cylinder 153*a*, an inking device 154*a*, and a dampening device 155*a* for one side to constitute an offset printing portion for one side. Moreover, the fourth offset printing unit 150 includes an impression cylinder 151*b*, a blanket cylinder 152*b*, a plate cylinder 153*b*, an inking device 154*b*, and a dampening device 155*b* for the other side to constitute an offset printing portion for the other side.

As also illustrated in FIG. 2, the impression cylinder 151*b* for the other side of the fourth offset printing unit 150 is in contact with a transport cylinder 171Aa for one side of a first drying unit 170A downstream in the direction of rotation of the position of contact between the impression cylinder 151*b* and blanket cylinder 152*b*. In the vicinity of the transport cylinder 171Aa, dryers 172Aa for one side are provided. The dryers 172Aa for one side are drying means for one side for drying one side of each sheet 101 that is printed by the first to fourth offset printing units 120, 130, 140, and 150. The transport cylinder 171Aa is in contact with a transport cylinder 171Ab for the other side downstream in the direction of rotation of the position of contact between the transport cylinder 171Aa and the impression cylinder 151*b* for the other side of the fourth offset printing unit 150. In the vicinity of the transport cylinder 171Ab, dryers 172Ab for the other side are provided. The dryers 172Ab for the other side are drying means for the other side for drying the other side of each sheet 101 that is already printed by the first to fourth offset printing units 120, 130, 140, and 150.

Downstream in the direction of rotation of the position of contact between the transport cylinder 171Ab for the other side of the first drying unit 170A and the transport cylinder 171Aa for one side, a screen printing unit (screen printing apparatus) 160 is provided. The transport cylinder 171Ab is in contact with a transfer cylinder (upstream sheet transport device) 161. The transfer cylinder 161 is in contact with an impression cylinder 162 downstream in the direction of rotation of the position of contact between the transfer cylinder 161 and the transport cylinder 171Ab for the other side. The impression cylinder 162 is in contact with a rotary screen cylinder 163 downstream in the direction of rotation of the position of contact between the impression cylinder 162 and the transfer cylinder 161.

As illustrated in FIG. 3, the transfer cylinder 161 is located above the impression cylinder 162, and the rotary screen cylinder 163 is thereby located to the side of the impression cylinder 162. Accordingly, the rotary screen cylinder 163 performs screen printing on the other side of each sheet 101 which is fed from the transfer cylinder 161 and is gripped by a sheet gripping device (sheet holding device) 164 of the impression cylinder 162 to be then transported on the impression cylinder 162.

To the rotary screen cylinder 163, a screen plate 20*a* is attached. The screen plate 20*a* is a cylindrical plate material with small holes 20*d* etched corresponding to an image (see FIGS. 2 and 3). Inside of the rotary screen cylinder 163, a squeegee shaft (support shaft) 21 and a squeegee 23 are provided. The squeegee shaft 21 is supported by frames at the both ends so as to move in the radial direction and is configured to supply ink, varnish, or the like (screen printing liquid). The squeegee 23 pushes out the ink, varnish, or the like supplied from the squeegee shaft 21, through the small holes 20*d* of the screen plate 20*a* to supply the same toward the impression cylinder 162. The squeegee 23 and squeegee shaft 21 constitute a squeegee portion. An installation angle θ of the squeegee 23 is set at not less than 0 degrees with respect to a horizontal plane H in a lateral direction of the squeegee 23, a direction orthogonal to the longitudinal direction of the squeegee 23, that is, the radial direction of the rotary screen cylinder 163.

The configuration of the screen printing apparatus is described in detail later.

The impression cylinder 162 includes a gap guard 168 so as to cover a cutout portion 162*a* and is continuous with the outer circumferential surface of the impression cylinder 162. The gap guard 168 includes a guiding surface 168*a* that is provided between one end and the other end of the cutout portion 162*a* of the impression cylinder 162 and has a substantially same curvature as that of the outer circumferential surface of the impression cylinder 162. Moreover, the sheet gripping device 164 as the sheet holding device is supported within the cutout portion 162*a* of the impression cylinder 162 so as to rotate about a gripper shaft 164*a*. Rotation of the gripper shaft 164*a* allows a gripper 169 to open or close, thus holding or releasing the sheet 101. The outer side surface of the gripper 169 includes a guide surface 169*a* having a substantially same curvature as the outer circumferential surface of the impression cylinder 162 and is continuous with the outer circumferential surface of the impression cylinder 162 at the one end of the cutout portion 162*a*. This prevents the rotary screen cylinder 163 from falling into the cutout portion 162*a* or being dented by the gripper 169, thus giving the screen plate 20*a* a longer life.

The impression cylinder 162 of the screen printing unit 160 is in contact with a transfer cylinder 173 downstream in the direction of rotation of the position of contact between the impression cylinder 162 and the rotary screen cylinder 163. The transfer cylinder 173 is in contact with a transport cylinder 171B of a second drying unit 170B downstream in the direction of rotation of the position of contact between the transfer cylinder 173 and the impression cylinder 162 of the screen printing unit 160. In the vicinity of the transport cylinder 171B, dryers 172B are provided. The dryers 172B are drying means for drying the other side of each sheet 101 that is screen-printed by the screen printing unit 160.

The transport cylinder 171B is in contact with a suction cylinder 181 of a convertible unit 180 downstream in the direction of rotation of the position of contact between the transport cylinder 171B and the transfer cylinder 173 of the screen printing unit 160. The suction cylinder 181 is in contact with a convertible cylinder 182 downstream in the direction of rotation of the position of contact between the suction cylinder 181 and the transport cylinder 171B of the second drying unit 170B. The convertible unit 180 is configured to properly choose according to the print specification whether to transport the sheet 101 without turning the sheet 101 upside down for the purpose of performing post-treatment on the other side of the sheet 101 that is screen-printed by the screen printing unit 160 and is dried by the second drying unit 170B or to transport the sheet 101 after turning the sheet 101 upside down for the purpose of performing post-treatment for one side of the sheet 101 not screen-printed.

The convertible cylinder 182 is in contact with a transfer cylinder 174 downstream in the direction of rotation of the position of contact between the convertible cylinder 182 and the suction cylinder 181. The transfer cylinder 174 is in contact with a transfer cylinder 175 downstream in the direction of rotation of the position of contact between the transfer cylinder 174 and the convertible cylinder 182.

The transfer cylinder 175 is in contact with a transfer cylinder 191 of an intaglio printing unit (intaglio printing apparatus) 190 downstream in the direction of rotation of the position of contact between the transfer cylinder 175 and the transfer cylinder 174. The transfer cylinder 191 is in contact with an impression cylinder 192 downstream in the direction of rotation of the position of contact between the transfer cylinder 191 and the transfer cylinder 175.

The impression cylinder 192 is in contact with an intaglio cylinder 193 downstream in the direction of rotation of the position of contact between the impression cylinder 192 and the transfer cylinder 191. The intaglio cylinder 193 is in contact with an ink collecting cylinder 194 downstream in the direction of rotation of the position of contact between the intaglio cylinder 193 and the impression cylinder 192. The ink collecting cylinder 194 is in contact with plural ink form cylinders 195 arranged in the circumferential direction (five cylinders 195 in the example of FIG. 1). In the circumferential side of each ink form cylinder 195, a not-shown inking device supplying ink is provided. The inking devices are supported within a frame 190A, which is capable of moving close to or apart from the ink form cylinder 195. The intaglio cylinder 193 is in contact with a wiping roller 196 downstream in the direction of rotation of the position of contact between the intaglio cylinder 193 and the ink collecting cylinder 194. Under the wiping roller 196, a wiping tank 197 is provided.

The impression cylinder 192 of the intaglio printing unit 190 is in contact with a delivery cylinder 113 of a sheet delivery device 112 downstream in the direction of rotation of the position of contact between the impression cylinder 192 and the intaglio cylinder 193. The delivery cylinder 113 is provided coaxially with not-shown sprockets, around which an endless transport chain 114 provided with plural gripper bars is wound. Under the transport chain 114, plural sheet stacking tables 115A to 115C (three tables in the example shown in the drawing) are provided in the direction of travel of the transport chain 114.

The above-described first to fourth offset printing units 120, 130, 140, and 150 each constitute one module including the offset printing portion for one side and the offset printing portion for the other side and can be connected to one another to be provided in plural. The maximum number of colors necessary for printing can be easily set corresponding to the number of offset printing units.

In this embodiment, the transport cylinder 171Aa for one side and the transport cylinder 171Ab for the other side of the first drying unit 170A, the transfer cylinder 161 and impression cylinder 162 of the screen printing unit 160, the transport cylinder 173, the transport cylinder 171B of the second drying unit 170B, the suction cylinder 181 and convertible cylinder 182 of the convertible unit 180, the transfer cylinders 174 and 175, and the transfer cylinder 191 of the intaglio printing unit 190 constitute respective sheet feeding cylinders that feed each sheet 101 subjected to offset printing by the first to fourth offset printing units 120, 130, 140, and 150 to the impression cylinder 192 of the intaglio printing unit 190.

Next, a description is given of the configuration and operating mechanism of the screen printing apparatus according to the embodiment in detail with reference to FIGS. 4 to 10.

As illustrated in FIG. 4, in the screen printing unit 160, the rotary screen cylinder 163 is in contact with the impression cylinder 162 (provided) to the side of the impression cylinder 162 and downstream in the sheet transport direction of the position of contact between the impression cylinder 162 and transfer cylinder 161. As the sheet 101 that is fed from the first drying unit 170A as a pre-treatment processing unit and is transferred from the transfer cylinder 161 to the impression cylinder 162 passes the position of contact between the impression cylinder 162 and the rotary screen cylinder 163, the front surface (the other side) of the sheet 101 is screen-printed with ink (liquid). The screen-printed sheet 101 is transferred to the transfer cylinder 173 and is fed to the second drying unit 170B as a post-treatment processing unit.

As illustrated in FIGS. 5 and 6, in the rotary screen cylinder 163, the squeegee shaft 21 is penetrated in the cylinder shaft direction, and the long plate squeegee 23 is supported on the squeegee shaft 21 with a bracket 22 interposed therebetween along the squeegee shaft 21. To be specific, the base end of the squeegee 23 is fixed and supported on the bracket 22 with a fixed plate 24 interposed therebetween with bolts 25. The top end of the squeegee 23 is positioned so as to abut on an inner circumferential surface of the rotary screen cylinder 163 (to be strict, the cylindrical screen plate 20*a*).

On the base end of the surface of the squeegee 23 on the upstream side in the direction of rotation of the rotary screen cylinder 163, that is, the surface of the squeegee 23 (upper surface in FIG. 4) on the downstream side in the direction of relative movement of the squeegee 23 to the rotary screen cylinder 163, a regulation plate 26 is provided. The regulation plate 26 is configured to cover a space S, which is formed upstream in the direction of rotation of the abutment part of the squeegee 23 on the rotary screen cylinder 163, that is, downstream of the squeegee 23 in the direction of the relative movement of the squeegee 23. The regulation plate 26 is attached so as to cover the opening of the space S that is formed by the squeegee 23 and rotary screen cylinder 163 except a very small part of the opening. The base end of the regulation plate 26 is attached with no gap while the top end thereof is extended toward the inner circumferential surface of the rotary screen cylinder 163 so as not to be in contact with the inner circumferential surface of the rotary screen cylinder 163 with a gap provided therebetween.

On both ends of the regulation plate 26 in the longitudinal direction, that is, on the both ends thereof in the horizontal direction orthogonal to the direction of movement (in the right-left direction in FIGS. 5 and 6), a pair of weir portions 27 covering the space S are extended toward the inner circumferential surface of the rotary screen cylinder 163 so as not to be in contact with the inner circumferential surface of the rotary screen cylinder 163 with a gap provided therebetween. The weir portions 27 close most of the space S with small openings left at the respective ends in the horizontal direction orthogonal to the direction of movement in the space S. The weir portions 27 are integrally formed with the regulation plate 26 by folding the both ends of the regulation plate 26 in the longitudinal direction.

One end of the regulation plate 26 (at the left end in FIGS. 5 and 6) communicates with one end of an ink supply tube 28, and the other end of the ink supply tube 28 communicates with an ink tank 29 installed outside of the rotary screen cylinder 163. Ink accumulated in the ink tank 29 is supplied to the one end on the squeegee 23 (the left end in FIGS. 5 and 6) by a supply pump 30, which is interposed in the ink supply tube 28. The ink supply tube 28, supply pump 30, ink tank 29, and the like constitute a liquid supply device.

On the other hand, under the other end of the squeegee 23 (the right end in FIGS. 5 and 6), an ink receiving tray 31 is provided. The ink receiving tray 31 is capable of storing ink flowing out from the other end of the squeegee 23 in the cylinder shaft direction of the impression cylinder 162. The ink receiving tray 31 communicates with one end of an ink recovery tube 32 while the other end of the ink recovery tube 32 communicates with the ink tank 29 so that the ink stored in the ink receiving tray 31 is recovered into the ink tank 29 with a recovery pump 33 interposed in the ink recovery tube 32. The ink recovered through the ink recovery tube 32 into the ink tank 29 is stirred in the ink tank 29 for preparation and is then supplied again through the ink supply tube 28 onto the squeegee 23. The ink receiving tray 31, ink recovery tube 32, recovery pump 33, ink tank 29, and the like constitute a liquid recovery device. It is certain that the configuration of the liquid recovery device of the present invention is not limited to that of the embodiment. For example, the liquid recover device may be configured without the ink receiving tray 31. In this case, ink is caused to directly flow from the other end of the squeegee 23 to the ink recovery tube 32 to be recovered into the ink tank 29 with the recovery pump 33.

The squeegee 23 is inclined in the longitudinal direction of the squeegee 23, that is, in the shaft direction of the rotary screen cylinder 163 so that the one end of the squeegee 23 to which ink is supplied through the ink supply tube 28 is higher than the other end thereof from which the ink is recovered through the ink recovery tube 32. The angle of inclination of the squeegee 23 can be adjusted by a later-described squeegee angle adjustment device. Moreover, the rotary screen cylinder 163 and impression cylinder 162 can be also inclined as needed.

FIGS. 7 to 9 illustrate a structure to support the rotary screen cylinder 163. The rotary screen cylinder 163 is supported between right and left frames 40 with eccentric bearings 41 interposed therebetween so as to incline upward or downward. The right and left eccentric bearings 41 are supported on the right and left frames 40 so as to rotate and slide in the right-left direction (the shaft direction).

In the rotary screen cylinder 163, the cylindrical screen plate 20*a* is supported between right and left holders 20*c* with flanges 20*b* interposed therebetween. The rotary screen cylinder 163 is rotatably supported by the bearings 42 relative to the eccentric bearings 41 at small-diameter portions of the respective right and left holders 20*c*. The screen plate 20*a* includes a number of small holes 20*d* corresponding to an image (see FIGS. 5 and 6).

On one end of the small-diameter portion of the right holder 20*c*, a gear 43 is fixed. The gear 43 is engaged with a gear 45 fixed on the output shaft of a motor 44. The motor 44 is attached to a sub-frame 46. The sub-frame 46 is joined to the right frame 40.

Accordingly, the rotary screen cylinder 163 is rotatably driven by the motor 44 through the aforementioned gear mechanism and is capable of performing circumferential register adjustment.

The right and left eccentric bearings 41 are pin-connected to ends of respective links 47, and the other ends of the links 47 are pin-connected to ends of respective levers 48. Middle portions of the right and left levers 48 in the longitudinal direction are fixed to respective rotary shafts 49, which are rotatably supported on the right and left frames 40. The other ends of the right and left levers 48 are pin-connected to the top ends of threaded members 50*a* of right and left ball screws 50, respectively.

The base end portions of the right and left threaded members 50*a* are screwed into nut members 50*b*, which are fixed in respective right and left support cases 51. Gears 52*a* fixed at the base ends of the right and left threaded members 50*a* are engaged with gears 52*b* fixed to the output shafts of right and left motors 53, respectively. The right and left motors 53 are properly attached to the frames 40.

Accordingly, when at least one of the right and left motors 53 is operated to rotate the eccentric bearings 41 through the aforementioned ball screws 50, the one end of the rotary screen cylinder 163 is eccentrically rotated, and the difference in eccentricity between the one end and the other end of the rotary screen cylinder 163 creates an upward or downward inclination of the rotary screen cylinder 163.

As illustrated in FIGS. 8 an 9, the aforementioned squeegee shaft 21 is penetrated through the rotary screen cylinder 163, and the right end of the squeegee shaft 21 is fitted in a fitting hole 54*a* of a receiving member 54, which is located outside of the sub-frame 46 and is supported so as to rotate and move (slide) in the right-left direction (the shaft direction). On the other hand, the left end thereof is fitted and supported by a receiving member 55, which is located outside of the left frame 40, so as not to rotate and move (slide) in the right-left direction (the shaft direction).

To be specific, movement (sliding) of the left end of the squeegee shaft 21 in the right-left direction (the shaft direction) is prevented by two right and left step portions 21*b* and 21*a*. Moreover, rotation of the left end of the squeegee shaft 21 is prevented in such a manner that the left end thereof is accommodated in a fitting recess 55*a*, which has a tapered bottom, of a receiving member 55 and is held from above with a holding plate 56*a*.

The holding plate 56*a* horizontally rotates about a support pin 57 to open or close the fitting recess 55*a*. The fitting recess 55*a* is kept closed by screwing a fixing lever 56*b* into the holding plate 56*a* and receiving member 55 with the fitting recess 55*a* being closed.

The right and left receiving members 54 and 55 are supported on support cases 60, which are respectively provided for the sub-frame 46 and frame 40, so as to move up and down through respective ball screws 61. To be specific, nut members 61*a* of the ball screws 61 are fixed in the respective support cases 60, and threaded members 61*b*, which are screwed to the nut members 61*a*, are vertically penetrated through the respective support cases 60. Not-threaded shaft portions of the threaded members 61*b* are rotatably supported within the support cases 60 with bearings 62 interposed therebetween.

The upper ends of the threaded members 61*b* are engaged with engagement holes 55*b* and 54*b* of the right and left receiving members 55 and 54 with spherical bearings 63 interposed therebetween so as to allow rotation of the threaded members 61*b* and inclination of the squeegee shaft 21 in the process of later-described position adjustment of the squeegee shaft 21. On the other hand, the lower ends of the threaded members 61*b* are fixed to respective gears 64*a*, which are engaged with respective gears 64*b* fixed to the output shafts of motors 65A and 65B. The left motor 65A and right motor 65B are attached to the outer side surfaces of the frame 40 and sub-frame 46, respectively.

Reference numeral 66 in FIG. 7 indicates anti-rotation pins which are configured to position the receiving members 54 and 55 in the absence of the squeegee shaft 21 and to position the squeegee shaft 21 in the front-back direction.

Accordingly, by individually driving the right and left motors 65B and 65A (or driving one of the right and left motors 65B and 65A) to move up and down the receiving members 55 and 54 through the ball screws 61 relatively to the respective support cases 60, the heights (positions) of the right and left ends of the squeegee shaft 21 can be arbitrarily adjusted individually.

In other words, by setting the left end of the squeegee shaft 21 higher than the right end, as illustrated in FIG. 5, the squeegee 23 supported by the squeegee shaft 21 is inclined so that one end thereof to which ink is supplied through the ink supply tube 28 is located higher than the other end from which ink is recovered through the ink recovery tube 32. Thus, the right and left motors 65B and 65A, right and left ball screws 61, right and left receiving members 55 and 54, squeegee shaft 21, and the like constitute a squeegee angle adjustment device.

The right and left shaft ends of the impression cylinder 162 are respectively supported on the right and left frames 40 with bearings 70*b* and 70*a* interposed therebetween. In order to incline the impression cylinder 162, as illustrated in FIG. 10, at least the bearing 70*a* at the left end is supported on the left frame 40 with an eccentric bearing 71 interposed therebetween.

Accordingly, when the eccentric bearing 71 is rotated with proper means, the impression cylinder 162 can be inclined so that the left end of the impression cylinder 162 is located higher than the right end thereof.

As described above, the screen printing apparatus according to the embodiment includes the transfer cylinder 161, impression cylinder 162, the rotary screen cylinder 163, and the squeegee angle adjustment device.

Next, a description is given of an operation of the combination printing press according to the embodiment with reference to FIG. 1.

When the sheets 101 are fed one by one from the sheet feeder 110, each of the sheets 101 is transferred from the feeder board 111 through the transfer cylinder 120*a* of the first offset printing unit 120 to the impression cylinder 121*a* and is then held with the one side facing out.

Various type of ink from the inking device 124*a* is fed through a not-shown train of rollers to the plate cylinder 123*a* and is transferred onto the blanket cylinder 122*a* to form picture lines corresponding to the image of the plate cylinder 123*a*.

As the sheet 101 passes between the impression cylinder 121*a* and blanket cylinder 122*a*, the ink transferred onto the surface of the blanket cylinder 122*a* is transferred to the one side of the sheet 101 held on the circumferential surface of the impression cylinder 121*a*.

The sheet 101 with the one side printed on the impression cylinder 121*a* is transported and gripped by the impression cylinder 121*b*, so that the sheet 101 is held by the impression cylinder 121*b* with the other side facing out.

Various ink from the inking device 124*b* is fed to the plate cylinder 123*b* through a not-shown train of rollers and is transferred to the blanket cylinder 122*b* to form picture lines corresponding to the image of the plate cylinder 123*b*.

As the sheet 101 passes between the impression cylinder 121*b* and blanket cylinder 122*b*, the ink transferred onto the surface of the blanket cylinder 122*b* is transferred to the other side of the sheet 101 held on the circumferential surface of the impression cylinder 121*b*.

The sheet 101 with the other side printed on the impression cylinder 121*b* is transported and gripped by the impression cylinder 131*a* of the second offset printing unit 130, so that the sheet 101 is held by the impression cylinder 131*b* with the one side facing out.

Subsequently, in a similar manner to the case of the first offset printing unit 120, the sheet 101 is subjected to printing on the one side and is then subjected to printing on the other side in the second offset printing unit 130. The sheet 101 is then transferred to the third printing unit 140.

Hereinafter, in a similar manner to the case of the first offset printing unit 120, the sheet 101 is subjected to printing on both sides in the third and fourth offset printing units 140 and 150 and is then gripped by the printing transport cylinder 171Aa for one side of the first drying unit 170A. The sheet 101 is therefore held by the transport cylinder 171Aa with the one side facing out and is transported as the ink on the one side thereof is dried by the dryers 172Aa for one side. The sheet 101 is then gripped by the transport cylinder 171Ab for the other side. The sheet 101 is therefore held by the transport cylinder 171Ab with the other side facing out and is transported as the ink on the other side is dried by the dryers 172Ab for the other side.

Next, the sheet 101 is gripped by the transfer cylinder 161 of the screen printing unit 160 and is then gripped by the impression cylinder 162. The sheet 101 is therefore held and transported by the impression cylinder 162 with the other side facing out as being subjected to screen printing on the other side by the rotary screen cylinder 163. The sheet 101 is then gripped by the transport cylinder 171B of the second drying unit 170B through the transfer cylinder 173. The sheet 101 is therefore held and transported by the transport cylinder 171Ba with the other side facing out as the ink on the other side due to screen printing is dried by the dryers 172B.

The screen printing in the screen printing unit 160 is described in detail later.

Subsequently, the sheet 101 is gripped by the suction cylinder 181 of the convertible unit 180 and is therefore held and transported in such a manner that the rear edge (trailing edge) is sucked by the suction cylinder 181 with the one side facing out while the leading edge thereof is gripped by a sheet gripping device.

In the convertible unit 180, it is properly selected whether to transport the sheet 101 directly (without turning the sheet 101 over) in order to perform intaglio printing for the other side of the sheet 101 already screen-printed as described above or to transport the sheet 101 after turning the sheet 101 over in order to perform intaglio printing for one side not screen-printed. To be specific, in the case of not turning the sheet 101 over, the leading edge of the sheet 101 transported on the suction cylinder 181 is gripped by the sheet gripping device of the convertible cylinder 182. On the other hand, in the case of turning the sheet 101 over, the trailing edge of the sheet 101 transported on the suction cylinder 181 is gripped by the sheet gripping device of the convertible cylinder 182.

Hereinafter, a description is given of the case of reversing the sheet 101, that is, performing intaglio printing for one side of the sheet 101 not screen-printed.

After the leading edge of the sheet 101 transported on the suction cylinder 181 with the one side facing out passes the position of sheet delivery to the convertible cylinder 182 and is transported on the suction cylinder 181, the trailing edge of the sheet 101 is gripped by the sheet gripping device of the convertible device cylinder 182. The sheet 101 is then held and transported by the convertible cylinder 182 with the one side facing out.

Subsequently, the sheet 101 is gripped by the transfer cylinder 174 and is held and transported by the transfer cylinder 174 with the other side facing out. The sheet 101 is then gripped by the transfer cylinder 175 and is held and transported by the transfer cylinder 175 with the one side facing out.

Next, the sheet 101 is fed through the transfer cylinder 191 of the intaglio printing unit 190 and is gripped by the impression cylinder 192. The sheet 101 is then held on the circumferential surface of the impression cylinder 192 with the one side facing out.

Herein, the various types of ink within a not-shown inking device are transferred to the ink collecting cylinder 194 through the ink form cylinder 195 and are supplied to the intaglio cylinder 193. Surplus ink is removed by the wiping roller 196 and is cleaned and removed in the wiping tank 197.

As the sheet 101 passes between the impression cylinder 192 and intaglio cylinder 193, the ink supplied to the intaglio plate of the intaglio cylinder 193 is transferred to the one side of the sheet 101 held on the circumferential surface of the impression cylinder 192. The sheet 101 is then held by the gripper bars of the transport chain 114 and is transported through the delivery cylinder 113 of the sheet delivery device to be delivered to the sheet stacking tables 115A and 115B.

The case of not reversing the sheet 101, that is, performing intaglio printing for the other side of the sheet 101 already screen-printed is obvious and is not described.

Next, a description is given of the screen printing in the screen printing unit 160 in detail with reference to FIGS. 1 to 6.

As described above, when the sheet 101 supplied from the first drying unit 170A as the pre-treatment processing unit and transferred from the transfer cylinder 161 to the impression cylinder 162 passes the position of contact between the impression cylinder 162 and rotary screen cylinder 163, screen printing with ink is performed for the other side of the sheet 101 (see FIG. 2).

In other words, the ink supplied onto the squeegee 23 within the rotary screen cylinder 163 is pushed out to the surface of the sheet 101 held on the impression cylinder 162 from the number of holes 20*d* formed in the screen plate 20*a* (see FIG. 6).

In the aforementioned process of screen printing, if the rotary screen cylinder 163 is broken because of deterioration of the screen plate 20*a* due to aging or the like, ink accumulated within the rotary screen cylinder 163 could leak to the outside.

In this embodiment, the rotary screen cylinder 163 is provided to the side of the impression cylinder 162. This can minimize the damage due to the screen printing liquid on the peripheral devices including the impression cylinder 162 in the event of breakage of the rotary screen cylinder 163 (see FIGS. 1 to 4).

According to this embodiment, in the screen printing unit 160, the transfer cylinder 161, which is configured to transfer the sheet 101 to the impression cylinder 162, is located above the impression cylinder 162, and the space thereby created is used to locate the rotary screen cylinder 163 to the side of the impression cylinder 162 so that ink, varnish, or the like accumulates in the squeegee portion of the rotary screen cylinder 163. Specifically, the installation angle θ of the squeegee 23 is set at not less than 0 degrees with respect to the horizontal plane H in the lateral direction of the squeegee 23, a direction orthogonal to the longitudinal direction of the squeegee 23, that is, the radial direction of the rotary screen cylinder 163 (see FIG. 3).

For the impression cylinder 162 is not located under the rotary screen cylinder 163, it is possible to minimize the damage due to the screen printing liquid, such as ink and varnish, on the impression cylinder 162 and the like in the event of breakage of the screen plate 20*a* of the rotary screen cylinder 163 without impairing the function of supplying the screen printing liquid to the sheets in the process of printing. The reliability of the machine is therefore increased.

Moreover, in the process of screen printing, the regulation plate 26 limits movement of the ink on the squeegee 23 in the rotary screen cylinder 163 toward the upstream in the direction of rotation of the rotary screen cylinder 163, that is, toward the downstream in the direction of relative movement of the squeegee 23 to the rotary screen cylinder 163, so that ink is held within the space S of the rotary screen cylinder 163. This can prevent the ink from being circulated and largely stirred together with rotation of the rotary screen cylinder 163. Even if the impression cylinder 162 and rotary screen cylinder 163 are rotated at high speed for high-speed screen printing, therefore, it is possible to considerably reduce the amount of forming ink by reducing the amount of air introduced into the ink (see FIG. 4).

Moreover, the weir portions 27 on the squeegee 23 limit the movement of ink flowing out of the both ends of the squeegee 23 in the longitudinal direction towards the cylinder shaft of the rotary screen cylinder 163, so that the ink returns to the middle of the squeegee 23 in the longitudinal direction (see FIG. 5).

Accordingly, the ink on the squeegee 23 is effectively pushed out evenly onto the surface of paper on the impression cylinder 162 through the holes 20*d* of the screen plate 20*a* with no waste, providing high-quality screen printing and reducing the amount of ink leaking out of the squeegee 23. This can prevent the members such as end rings located at both ends of the rotary screen cylinder 163 from being contaminated with ink and therefore facilitate the maintenance including cleaning (see FIG. 6).

In this embodiment, moreover, the squeegee 23 is inclined so that the one end of the squeegee 23 to which ink is supplied through the ink supply tube 28 is located higher than the other end from which the ink is recovered through the ink recovery tube 32 as illustrated in FIG. 5, and the angle of inclination thereof is adjustable by the aforementioned squeegee angle adjustment device. The squeegee angle adjustment device can set the squeegee 23 at a proper inclination angle corresponding to the viscosity of ink, so that the printing quality can be maintained. To be specific, when the squeegee 23 is set at a proper inclination angle corresponding to the viscosity of ink, the ink does not stay on the squeegee 23 for a long time. Accordingly, ink can be prevented from being transformed by long-time exposure to the outside air. Moreover, ink is prevented from flowing so fast that the amount of ink pushed out through the holes 20*d* of the screen plate 20*a* onto the surface of paper on the impression cylinder 162 becomes insufficient. The printing quality can be therefore maintained.

Furthermore, the rotary screen cylinder 163 and impression cylinder 162 themselves can be inclined if needed for the inclination angle of the squeegee 23 is adjustable. When the rotary screen cylinder 163 is inclined at the same angle as that of the squeegee 23, the squeegee 23 evenly abuts on the rotary screen cylinder 163 over the entire length, so that the force of the squeegee 23 pushing ink out, that is, the amount of ink pushed out, is even in the axial direction of the rotary screen cylinder 163. The printing quality can be therefore maintained. When the impression cylinder 162 is inclined together with the inclination of the rotary screen cylinder 163, the direction of printing relative to the position of the sheet 101, that is, printing registration is not misaligned.

The ink therefore always flows on the squeegee 23. It is therefore possible to prevent deterioration of highly-volatile ink and thereby stabilize the characteristic of the ink, providing high-quality screen printing.

Especially in the case where printing by the screen printing unit 160 is performed for a particular small range, ink supplied to the holes 20*d* of the screen plate 20*a* among the ink supplied onto the squeegee 23 is printed and consumed, but ink supplied to the portion not including the holes 20*d* is not consumed and accumulated. Accordingly, highly-volatile ink is exposed to the outside air for a long time. This is more pronounced in the case where the rotary screen cylinder 163 is located to the side of the impression cylinder 162 as described in the embodiment than in the case where the rotary screen cylinder 163 is located above the impression cylinder 162 because the gravitational force acting on ink has less influence in the embodiment.

However, the ink can be effectively prevented from accumulating on the squeegee 23 by inclining at least the squeegee 23 so that the ink always flows and circulates as described in the embodiment.

The present invention is not limited to the above-described embodiment, and it is obvious that various types of changes can be made without departing from the scope of the present invention, including use of varnish as the screen printing liquid and changes in the mechanism to incline the squeegee, rotary screen cylinder, impression cylinder, and the like.

Moreover, the screen printing unit 160 is combined with the first to fourth offset printing units 120, 130, 140, and 150 and the intaglio printing unit 190, and the combination printing press can perform three types of printing in one pass. Accordingly, the versatility of the printing press is enhanced in addition to the aforementioned reliability of the screen printing unit 160 (see FIG. 1).

Furthermore, in the convertible unit 180, it can be properly selected according to the print specifications whether to directly transport the sheet 101 without turning the sheet 101 over in order to perform intaglio printing on the other side of the sheet 101 that is screen-printed by the screen printing unit 160 and is dried by the second drying unit 170B or to transport the sheet 101 after turning the sheet 101 over in order to perform intaglio printing on the one side of the sheet 101 that is not screen-printed. Accordingly, the combinations of printed surfaces (variations of front and reverse prints) can be easily selected and changed in a single printing apparatus at various types of printing. The versatility is therefore further enhanced.

INDUSTRIAL APPLICABILITY

The screen printing apparatus according to the present invention and the combination printing press including the screen printing apparatus can perform high quality printing while minimizing the damage due to screen printing liquid in the event of breakage of the screen of the rotary screen cylinder. Accordingly, the screen printing apparatus according to the present invention and the combination printing press including the screen printing apparatus can be very advantageously used in manufacturing screen prints. Moreover, various type of printing can be effectively performed in one pass with various combinations of print surfaces. Accordingly, the screen printing apparatus according to the present invention and the combination printing press including the screen printing apparatus can be very advantageously used in manufacturing bank notes such as bills and securities such as stock certificates and bonds.

REFERENCE SIGNS LIST

20*a* screen plate
20*b* flange
20*c* holder
20*d* hole
21 squeegee shaft (support shaft)
21*a*, 21*b* stepped portion
22 bracket
23 squeegee
24 fixed plate
25 bolt
26 regulation plate
27 weir portion
28 ink supply tube
29 ink tank
30 supply pump
31 ink receiving tray
32 ink recovery tube
33 recovery pump
40 frame
41 eccentric bearing
42 bearing
43 gear
44 motor
45 gear
46 sub-frame
47 link
48 lever
49 rotary shaft
50 ball screw
50*a* threaded member
50*b* nut member
51 support case
52*a* gear
52*b* gear
53 motor
54 receiving member
54*a* fitting hole
54*b* engagement hole
55 receiving member
55*a* fitting recess
55*b* engagement hole
56*a* holding plate
56*b* fixed lever
57 support pin
60 support case
61 ball screw
61*a* nut member
61*b* threaded member
62 bearing
63 spherical bearing
64*a*, 64*b* gear
65A, 65B motor
66 anti-rotation pin
70*a*, 70*b* bearing
71 eccentric bearing
100 combination printing press
101 sheet
110 sheet feeder
111 feeder board
112 sheet delivery device
113 delivery cylinder
114 transport chain
115A to 115C sheet stacking table
120 first offset printing unit (offset printing apparatus)
120*a* transfer cylinder for one side
121*a* impression cylinder for one side
122*a* blanket cylinder for one side
123*a* plate cylinder for one side
124*a* inking device for one side
125*a* dampening device for one side
121*b* impression cylinder for the other side
122*b* blanket cylinder for the other side
123*b* plate cylinder for the other side

124*b* inking device for the other side
125*b* dampening device for the other side
130 second offset printing unit (offset printing apparatus)
131*a* impression cylinder for one side
132*a* blanket cylinder for one side
133*a* plate cylinder for one side
134*a* inking device for one side
135*a* dampening device for one side
130*b* transfer cylinder for the other side
131*b* impression cylinder for the other side
132*b* blanket cylinder for the other side
133*b* plate cylinder for the other side
134*b* inking device for the other side
135*b* dampening device for the other side
140 third offset printing unit (offset printing apparatus)
141*a* impression cylinder for one side
142*a* blanket cylinder for one side
143*a* plate cylinder for one side
144*a* inking device for one side
145*a* dampening device for one side
140*b* transfer cylinder for the other side
141*b* impression cylinder for the other side
142*b* blanket cylinder for the other side
143*b* plate cylinder for the other side
144*b* inking device for the other side
145*b* dampening device for the other side
150 fourth offset printing unit (offset printing apparatus)
151*a* impression cylinder for one side
152*a* blanket cylinder for one side
153*a* plate cylinder for one side
154*a* inking device for one side
155*a* dampening device for one side
150*b* transfer cylinder for the other side
151*b* impression cylinder for the other side
152*b* blanket cylinder for the other side
153*b* plate cylinder for the other side
154*b* inking device for the other side
155*b* dampening device for the other side
160 screen printing unit (screen printing apparatus)
161 transfer cylinder
162 impression cylinder
163 rotary screen cylinder
164 sheet gripping device (sheet holding device)
170A first drying unit
171Aa transport cylinder for one side
172Aa dryer for one side
171Ab transport cylinder for the other side
172Ab dryer for the other side
170B second drying unit
171B transport cylinder
172B dryer
173 transfer cylinder
174 transfer cylinder
175 transfer cylinder
180 convertible unit
181 suction cylinder
182 convertible cylinder
190 intaglio printing unit (intaglio printing apparatus)
190A frame
191 transfer cylinder
192 impression cylinder
193 intaglio cylinder
194 ink collecting cylinder
195 ink form cylinder
196 wiping roller
197 wiping tank
H horizontal plane
θ angle of squeegee to horizontal plane
S space

The invention claimed is:

1. A screen printing apparatus, comprising:

an impression cylinder including a cutout portion that accommodates a sheet holding device therein for holding a sheet, the sheet holding device being configured to receive the sheet from an upstream sheet transport device through the sheet holding device and transport the sheet, the impression cylinder further including a gap guard that covers the cutout portion;

a downstream sheet transport device configured to receive the sheet from the impression cylinder; and a rotary screen cylinder being in contact with the impression cylinder and configured to perform screen printing for the sheet held on the impression cylinder, wherein the upstream sheet transport device is located above the impression cylinder, the downstream sheet transport device is located above the impression cylinder, the rotary screen cylinder is located to the side of the impression cylinder so that screen printing liquid accumulates in a squeegee portion of the rotary screen cylinder, and the sheet holding device has a gripper configured to open or close, thus holding and releasing a leading edge of the sheet, the screen printing apparatus further comprising:

a squeegee abutting on an inner circumferential surface of a cylindrical screen plate that is included in the rotary screen cylinder and having a plurality of holes, the squeegee being configured to push out liquid supplied to the inner circumferential surface of the screen plate through the holes onto a surface of the sheet held on the impression cylinder;

a tank configured to reserve the liquid;

a liquid supply device configured to supply the liquid reserved in the tank onto the squeegee; and a liquid recovery device configured to return the liquid flowing out of the squeegee to the tank, wherein the squeegee is inclined with respect to the horizontal plane in a longitudinal direction of the squeegee so that one end of the squeegee in the longitudinal direction is located higher than the other end thereof, and the liquid supply device supplies the liquid to the one end of the squeegee while the liquid recovery device recovers the liquid from the other end of the squeegee.

2. The screen printing apparatus according to claim 1, wherein an installation angle θ of a squeegee of the squeegee portion is set at not less than 0 degrees with respect to a horizontal plane in a lateral direction of the squeegee.

3. The screen printing apparatus according to claim 1, further comprising:

a squeegee angle adjustment device configured to adjust an angle of inclination of the squeegee with respect to the horizontal plane in the longitudinal direction of the squeegee.

4. The screen printing apparatus according to claim 1, wherein the gap guard has a guiding surface continuous with an outer circumferential surface of the impression cylinder defining the cutout portion.

5. A combination printing press, comprising:

the screen printing apparatus according to claim 1;

a convertible portion; and an intaglio printing apparatus.

6. The combination printing press according to claim 5, further comprising:

an offset printing apparatus.

* * * * *